US005687915A

United States Patent [19]

Schmitz et al.

[11] Patent Number: 5,687,915

[45] Date of Patent: Nov. 18, 1997

[54] OPERATING TRIGGER ASSEMBLY FOR A SPRAY FOR FLUID PRODUCTS

[75] Inventors: Jean-Claude Schmitz, Heisdorf; Leon Kerger, Helmdange, both of Luxembourg

[73] Assignee: Luxembourg Patent Company, S.A., Luxembourg, Luxembourg

[21] Appl. No.: 444,434

[22] Filed: May 19, 1995

[30] Foreign Application Priority Data

May 31, 1994 [LU] Luxembourg ..... 88 489

[51] Int. Cl.[6] ..... B05B 9/08

[52] U.S. Cl. ..... 239/530; 239/576

[58] Field of Search ..... 239/525, 530, 239/579, 587.1, 576, 587.5, 588; 222/513, 517, 533, 556, 558

[56] References Cited

U.S. PATENT DOCUMENTS

| | | | |
|---|---|---|---|
| 1,589,107 | 6/1926 | Campbell | 222/517 |
| 2,301,691 | 11/1942 | Ellinger | 239/530 |
| 3,042,315 | 7/1962 | Besser | 239/530 |
| 3,759,431 | 9/1973 | Vus | 222/517 |
| 4,344,578 | 8/1982 | Shames | 239/530 |
| 4,527,743 | 7/1985 | Etteinger | 239/530 |
| 5,114,051 | 5/1992 | Simon | 222/517 |

FOREIGN PATENT DOCUMENTS 0 635 310 A1 1/1995 European Pat. Off. .

*Primary Examiner*—Robert J. Oberleitner
*Assistant Examiner*—C. T. Bartz
*Attorney, Agent, or Firm*—Leydig, Voit & Mayer, Ltd.

[57] ABSTRACT

A trigger assembly comprising a handle through which there passes an axial duct and a spray mouth through which there passes an outlet passage. The posterior frontal face of the spray mouth and the anterior frontal face of the handle are surfaces with complimentary curvatures so that the spray mouth and the handle can pivot with respect to each other, against the action of elastic means, towards an open position in which the passage of the spray mouth and the duct of the handle are aligned with one another and, under the action of elastic means, towards the closed position in which the duct and the passage are not aligned with each other.

10 Claims, 2 Drawing Sheets

OPERATING TRIGGER ASSEMBLY FOR A SPRAY FOR FLUID PRODUCTS

FIELD OF THE INVENTION

The present invention relates to an operating trigger assembly for a spray for fluid products which is intended to be connected to a bottle containing the said product.

BACKGROUND OF THE INVENTION

Although not limited thereto, the invention more particularly concerns bottle-type extinguishers placed, as a security measure, in buildings, vehicles, factories, commercial premises, public places, etc. It is, however, also suitable for professional fire brigade equipment, or even for other applications.

These extinguishers include a bottle containing the extinguisher product which may be water or an extinguisher powder or a mixture of a powder and an inert gas such as nitrogen, as well as a nozzle equipped with an operating trigger assembly with a valve or tap to allow out the extinguisher product which is trapped under pressure in the bottle. The first criterion imposed on these extinguishers is to be operable quickly, with little effort and effectively.

In most extinguishers currently known, the operating trigger assembly includes a sealing member in the form of a piston or a disc which is held by a spring on a seat in the passage for the extinguisher product. Opening is brought about against the action of the spring by rotating or pulling on the sealing memberer.

These known devices do, however, exhibit certain number of drawbacks. One of these is that the sealing member remains in the flow of the extinguisher product, in the open position.

Given that the passage for this product is not completely freed, this inevitably results in a drop in pressure and a loss of effectiveness.

When the bottle contains an extinguisher powder, possible deposits of this powder onto the seat may impede the maintaining of good sealing. As a consequence of this, a powerful closure spring is required which, on the other hand, requires more effort for opening.

Luxembourgian Patent Application No. 88 376 makes it possible to eliminate most of these drawbacks by virtue of a new operating trigger assembly which stands apart from the rest as much through its simplicity and its effectiveness, as through its low production cost. In this trigger assembly, the sealing member consists of a rotary ball valve which forms an integral part of the operating handle.

SUMMARY OF THE INVENTION

The object of the present invention is to draw advantage from simplification by proposing a low-cost trigger assembly consisting of a minimum number of components, but with effectiveness at least equal to that of the known trigger assemblies.

In order to achieve this objective, the invention proposes an operating trigger assembly for a spray for fluid products which is intended to be connected to a bottle containing the said product, characterized in that it consists of a handle through which there passes an axial duct communicating with the said bottle and of a spray mouth through which there passes an outlet passage, in that the posterior frontal face of the spray mouth and the anterior frontal face of the handle are concave, respectively convex, surfaces with corresponding cylindrical curvatures and in that the spray mouth and the handle can be pivoted with respect to each other, against the action of elastic means, towards an open position in which the passage of the spray mouth and the duct of the handle are aligned with one another and, under the action of elastic means, towards a closed position in which the said duct and the said passage are not aligned with each other.

The trigger assembly proposed by the present invention is preferably made entirely of synthetic substance, which reduces its manufacturing cost.

The frontal face of the handle my include a seal forming the edge of the outlet of the duct passing through this handle.

The said elastic means may consist of a flexible tongue forming part of the handle and bearing on the spray mouth, or vice versa.

According to a first embodiment, the spray mouth and the handle are made as a single piece, the mouth being connected to the handle by a flexible strip forming a hinge with the handle to allow the mutual pivoting of these two components.

According to another embodiment, the spray mouth and the handle consist of separate components joined together by a pivot pin.

BRIEF DESCRIPTION OF THE DRAWINGS

Other particular features and characteristics will emerge from the detailed description of a few preferred embodiments given hereinbelow by way of illustration with reference to the appended drawings in which.

DETAILED DESCRIPTION OF THE PREFERRED EMBODIMENTS

Figure 1:
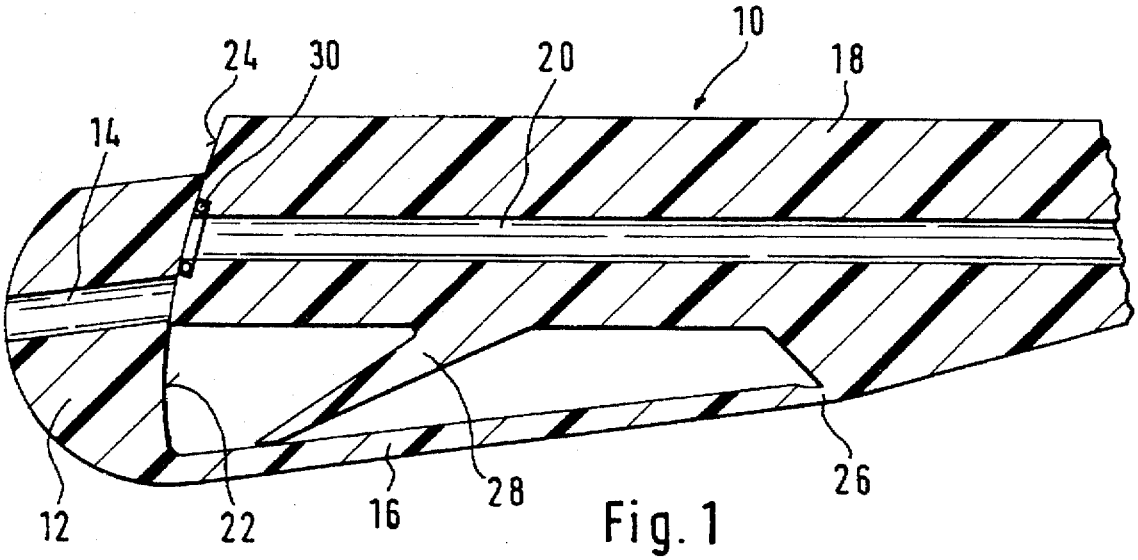
FIGS. 1 and 2 diagrammatically represent longitudinal sections through one embodiment, respectively in the closed position and in the open position.

The trigger assembly 10 represented in the figures includes a spray mouth 12 made of a synthetic substance through which there passes longitudinally an outlet duct 14 for the product which is directed, for example, in the case of an extinguisher, onto the base of a fire. On the opposite side to the outlet for the extinguisher product, the spray mouth is connected by a strip 16 to a handle 18 with which it forms an integral part.

The handle 18 has passing through it longitudinally a duct 20 which communicates via a flexible hose, not represented, with the inside of a bottle, not represented, containing the extinguisher product. The posterior face 22 of the extinguisher mouth 12 is a concave surface having cylindrical curvature, while the anterior face 24 of the handle 18 is a convex surface with cylindrical curvature corresponding to that of the face 22.

The connection between the spray mouth 12 and the handle 18 is such that these two components can pivot mutually one with respect to the other by means of the surface 22 gliding over the surface 24 or vice versa. This pivoting may be made possible by flexibility of the strip 16 or by a region 26 designed in the form of a hinge.

To improve sealing between the two complementary surfaces 22 and 24, it is preferable to provide a seal 30 on the frontal face 24 of the handle 18, which seal may form the outlet edge for the duct 20 passing through the handle.

A spring is provided for keeping the mouth 12 and the handle 18 in the closed position according to FIG. 1 according to which position the outlet of the duct 20 is closed off by the posterior face 22 of the spray mouth 12. This spring may consist, as represented in the figures, of a flexible tongue 28 forming part of the handle 18 and bearing on the strip 16 of the mouth 12. The tongue may equally well form part of the mouth 12 and bear on the handle 18. It is equally well possible to design the strip 16 in the form of a spring, giving it a certain degree of elastic flexibility which keeps it in the position of FIG. 1 and which thus allows the tongue 28 to be dispensed with.

Figure 2:
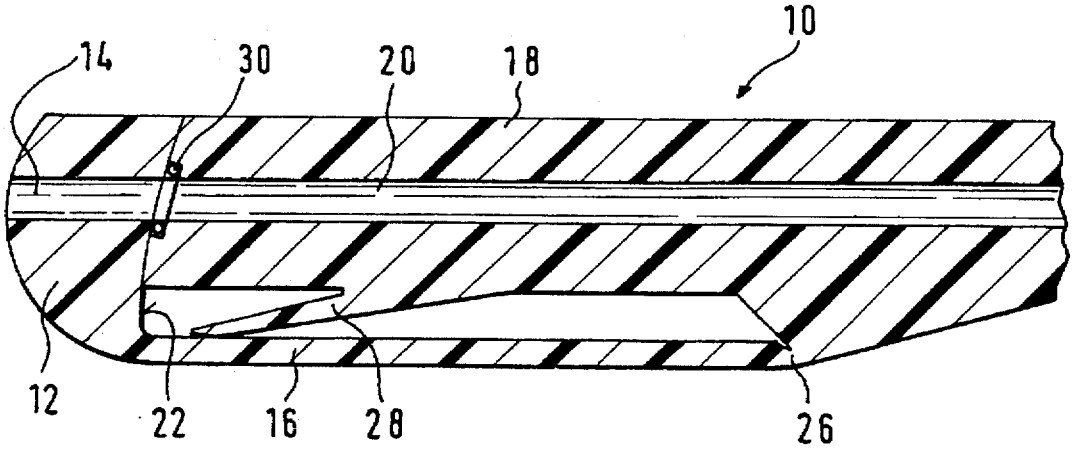

Operation of the trigger assembly represented in FIGS. 1 and 2 is extremely simple. In order to open it, all that is required is to grip it in one hand in order to pivot the handle 18 against the spray mouth 12 and vice versa in order to place the passage 14 in the extension of the duct 20 according to FIG. 2. To ensure that this position is correctly reached, it is possible to provide somewhere, for example between the strip 16 and the handle 18, a stop corresponding to the maximum open position and preventing the passage 14 from sliding beyond the duct 20. When the grip on the trigger assembly is released, the spring 28 returns the trigger assembly to the closed position according to FIG. 1.

To avoid accidental or unintentional operation, it is possible to equip the trigger assembly with a locking system which allows the trigger assembly to be opened only after the system has been unlocked.

Figure 3:
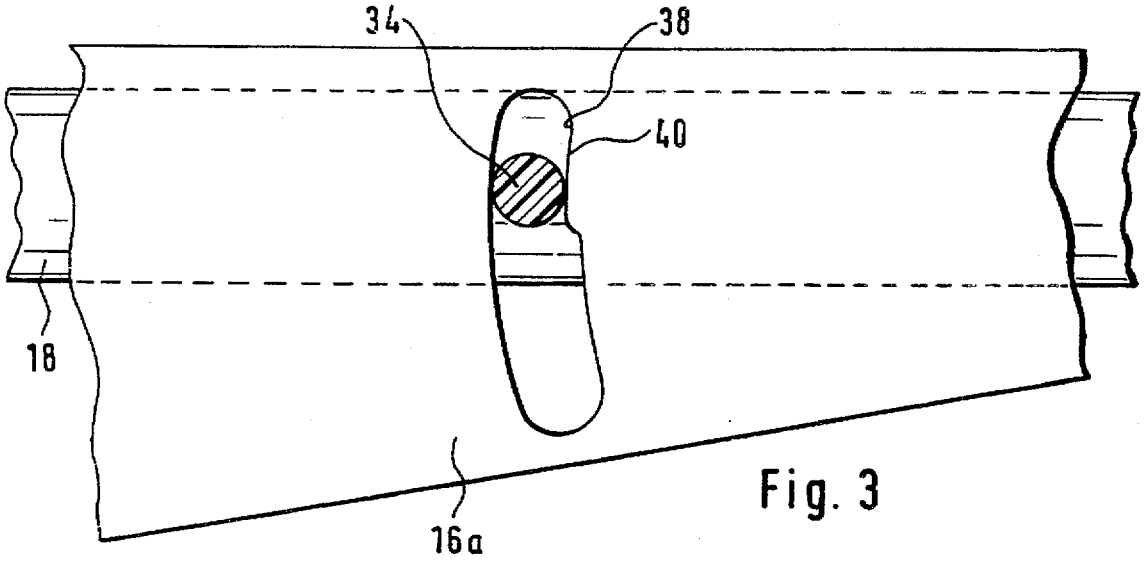
FIG. 3 represents a lateral view of an alternative with enhanced sealing.
Figure 4:
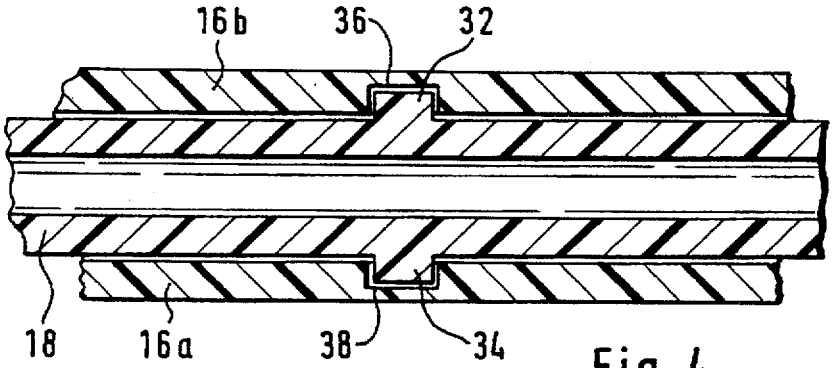
FIG. 4 represents a horizontal axial section of the alternative of FIG. 3.
Figure 5:
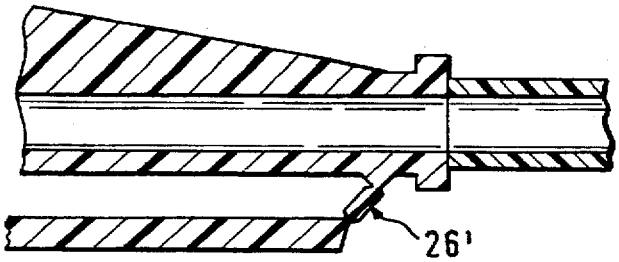
FIG. 5 represents one example of a double hinge between the handle and the spray mouth.

According to an advantageous embodiment illustrated in FIGS. 3 to 5, the strip 16 is extended laterally by two flanks **16*a* and 16*b* which also extend from the spray mouth 12 around the handle 18 to form a housing for the latter with a U-shaped cross-section. The handle 18 is provided with two lateral stubs 32, 34 which are engaged in circular grooves 36, 38 of the two flanks 16*a* and 16*b*. Each of these grooves includes a zone 40 (see FIG. 3) having a cam effect on its stub 32, 34 so as to tighten the spray mouth 12 still further onto the handle 18, or vice versa, in the closed position according to FIG. 1 in order to improve sealing at the adjacent faces 22 and 24. The circular grooves may moreover be designed to bring about a similar cam effect in the open position according to FIG. 2**.

The hinge at the connection between the mouth 12 and the handle 18 must, in this case, be produced so as to allow longitudinal gliding between the mouth 12 and the handle 18. FIG. 5 shows a very simple example of a double hinge 26' allowing such a longitudinal movement.

Instead of being connected to a hose connected to an extinguisher bottle, the trigger assembly envisaged by the invention may equally be mounted directly on the bottle and form the closure valve for the latter.

It is equally well possible to change around the trigger assembly described hereinabove and to permutate the functions of the spray mouth and of the handle. In this case, the end to the right of the element 18 would act as a spray mouth while the element 12 would be connected to the reservoir with the extinguished product.

What is claimed is:

1. A one piece trigger assembly for a spray for fluid products which is intended to be connected to a bottle containing said product, the one piece trigger assembly comprising a handle through which there passes an axial duct communicating with said bottle and a spray mouth through which there passes an outlet passage, the posterior frontal face of the spray mouth and the anterior frontal face of the handle being corresponding concave and convex surfaces, respectively, with cylindrical curvature, the spray mouth and the handle adapted to be pivoted with respect to each other, against the action of elastic means, towards an open position in which the passage of the spray mouth and the duct of the handle are aligned with one another and, under the action of said elastic means, towards a closed position in which said duct and said passage are not aligned with each other, said elastic means comprising a tongue extending from said handle.

2. The trigger assembly according to claim 1, wherein the spray mouth and the handle are made of a synthetic substance.

3. The trigger assembly according to claim 1 wherein the frontal face of the handle bears a seal forming the outlet edge of the duct passing through the handle.

4. The trigger assembly according to claim 1, wherein said elastic means comprising said tongue extending from said handle permits pivoted action between said spray mouth and said handle.

5. An operating trigger assembly for a spray for fluid products which is intended to be connected to a bottle containing said product, the trigger assembly comprising a handle through which there passes an axial duct communicating with said bottle and a spray mouth through which there passes an outlet passage, the posterior frontal face of the spray mouth and anterior frontal face of the handle being corresponding concave and convex surfaces, respectively with cylindrical curvature, the spray mouth and the handle adapted to be pivoted with respect to each other, against the action of elastic means, towards an open position in which the passage of the spray mouth and the duct of the handle are aligned with one another and, under the action of said elastic means, towards a closed position in which said duct and said passage are not aligned with each other, and the handle including two stubs engaged in grooves of the mouth having a cam effect for generating a clamping effect between the frontal faces of the mouth and of the handle in the closed position.

6. The trigger assembly according to claim 5, wherein the spray mouth forms an integral part of the handle.

7. The trigger assembly according to claim 6, further comprising a double hinge between the mouth and the handle.

8. The trigger assembly according to claim 5 wherein the spray mouth and the handle are made of a synthetic substance.

9. The trigger assembly according to claim 5 wherein the frontal face of the handle bears a seal forming the outlet edge of the duct passing through the handle.

10. The trigger assembly according to claim 5 wherein the elastic means comprises a flexible tongue forming part of the handle and bearing on the spray mouth.

* * * * *